US006637407B1

(12) United States Patent
Boecking

(10) Patent No.: US 6,637,407 B1
(45) Date of Patent: Oct. 28, 2003

(54) COMMON RAIL

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 102 days.

(21) Appl. No.: 09/857,630

(22) PCT Filed: Sep. 19, 2000

(86) PCT No.: PCT/DE00/03245

§ 371 (c)(1),
(2), (4) Date: Sep. 5, 2001

(87) PCT Pub. No.: WO01/25615

PCT Pub. Date: Apr. 12, 2001

(30) Foreign Application Priority Data

Oct. 7, 1999 (DE) ..... 199 48 339

(51) Int. Cl.[7] ..... F02M 41/00
(52) U.S. Cl. ..... 123/456; 123/447
(58) Field of Search ..... 123/456, 447, 123/468, 469; 138/26; 285/125.1

(56) References Cited

U.S. PATENT DOCUMENTS 6,135,091 A * 10/2000 Itoh et al. ..... 123/456
6,427,665 B1 * 8/2002 Knoedl et al. ..... 123/456
6,505,607 B1 * 1/2003 Mattes ..... 123/456

FOREIGN PATENT DOCUMENTS

DE 19953577 * 5/2001
WO WO 0134969 * 5/2001

* cited by examiner

*Primary Examiner*—Mahmoud Gimie
(74) *Attorney, Agent, or Firm*—Ronald E. Greigg

(57) ABSTRACT

The invention relates to a common rail for a common rail fuel injection system of an internal combustion engine, having a tubular base body whose interior communicates with a plurality of connections. To increase the high-pressure strength, the interior is formed by at least two substantially circular-cylindrical recesses or bores which communicate with one another and whose longitudinal axes are parallel to one another. The connections originate only at the jacket face of one of the substantially circular-cylindrical recesses.

17 Claims, 4 Drawing Sheets

COMMON RAIL

CROSS-REFERENCE TO RELATED APPLICATIONS

This application is a 35 USC 371 application of PCT/DE 00/03245 filed on Sep. 19, 2000.

BACKGROUND OF THE INVENTION

1. Field of the Invention

The invention relates to a common rail for a common rail fuel injection system of an internal combustion engine, having a tubular base body whose interior communicates with a plurality of connections.

2. Description of the Prior Art

In common rail injection systems, a high-pressure pump, optionally with the aid of a prefeed pump, pumps the fuel to be injected from a tank into the central high-pressure fuel reservoir, also known as a common rail. From the rail, fuel lines lead to the various injectors, which are assigned to the engine cylinders. The injectors are triggered individually by the engine electronics as a function of the engine operating parameters, in order to inject fuel into the engine combustion chamber. By means of the common rail, the pressure generation and the injection are decoupled from one another.

OBJECTS AND SUMMARY OF THE INVENTION

A conventional common rail is described for instance in German Patent Disclosure DE 195 48 611. The known common rail withstands pressures of up to about 1100 bar.

The object of the invention is to increase the high-pressure strength of the known common rail by simple provisions. Furthermore, the common rail of the invention should be economical to produce.

In a common rail for a common rail fuel injection system of an internal combustion engine, having a tubular base body whose interior communicates with a plurality of connections, this object is attained in that the interior is formed by at least two substantially circular-cylindrical recesses, which communicate with one another and whose longitudinal axes are parallel to one another, and in that the connections originate only at the jacket face of one of the substantially circular-cylindrical recesses. Within the context of the present invention, it has been found that the high-pressure strength of the common rail is limited primarily by the intersections between the connection openings and the base body interior. In operation, major forces act on the transitions between the connection openings and the base body. According to the present invention, the functions of storage and distribution of the base body interior are distributed between the two recesses. This makes it possible for the transitions that are especially critical with respect to high-pressure strength between the base body interior and the connection openings to be shaped optimally. Independently of the connections in the region of the jacket face of the circular-cylindrical recesses, connections can additionally be provided on the face ends of the circular-cylindrical recesses, because the intersection problems do not arise there.

A particular version of the invention is characterized in that the two substantially circular-cylindrical recesses communicate with one another through a connecting conduit. Separating the two circular-cylindrical recesses from one another means that pressure surges are not propagated from one circular-cylindrical recess to the other.

A further embodiment of the invention is characterized in that the two substantially circular-cylindrical recesses overlap in cross section. By means of the overlap, the available storage space is increased, without creating sharp edges that are critical with regard to the high-pressure strength.

A further version of the invention is characterized in that the two substantially circular-cylindrical recesses have the same diameters, and in that the connections are disposed only in the longitudinal direction of the cross section of the base body interior. The deformation seen in cross section, which is due to the high pressure prevailing in operation in the interior of the base body, is most pronounced perpendicular to the connections and thus occurs in a region that is not so heavily stressed.

A further version of the invention is characterized in that the two substantially circular-cylindrical recesses have different diameters, and in that the connections originate only at the jacket face of the substantially circular-cylindrical recess having the smaller diameter. As a result, the transition between the interior of the tubular base body and the connections is made less sharp, and the high-pressure strength of the common rail of the invention is improved.

A further version of the invention is characterized in that the spacing between the longitudinal axes of the two substantially circular-cylindrical recesses is greater than or equal to the radius of the substantially circular-cylindrical recess having the larger diameter. It is thus attained that the storage volume of the common rail of the invention is increased.

A further version of the invention is characterized in that the transitions between the two substantially circular-cylindrical recesses are rounded in cross section. The additional rounding leads to a further increase in the high-pressure strength of the common rail of the invention.

BRIEF DESCRIPTION OF THE DRAWINGS

Further features and advantages of the invention will become apparent from the ensuing description, taken in conjunction with the drawings in which.

DESCRIPTION OF THE PREFERRED EMBODIMENTS

Figure 1:
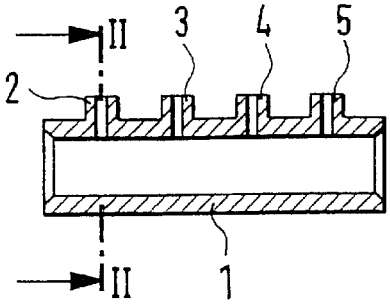
FIG. 1 is a common rail of the invention in longitudinal section.

The common rail shown in longitudinal section in FIG. 1 includes a tubular base body 1. Four connection stubs 2, 3, 4 and 5 are embodied on the tubular base body 1. The connection stubs 2, 3, 4 and 5 allow the connection of high-pressure fuel lines. The high-pressure fuel lines establish a communication between the interior of the tubular base body 1 and a high-pressure fuel pump (not shown) or the injectors (not shown) of the engine to be supplied.

Figure 2:
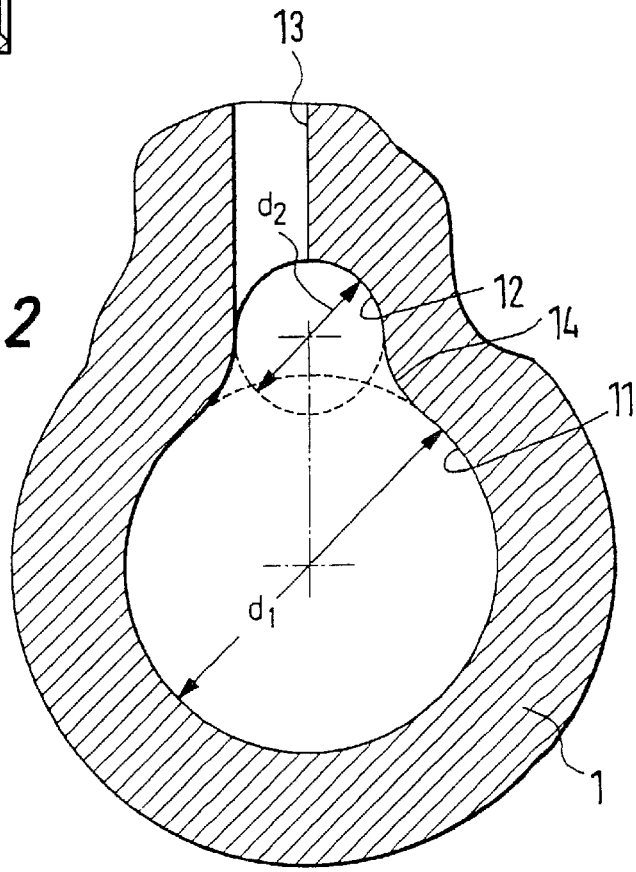
FIGS. 2–8 are various embodiments of the common rail of the invention in cross section, taken along the line II—II of FIG. 1.

In the cross section shown in FIG. 2, it can be seen that the interior of the tubular base body 1 is formed by a first longitudinal recess or bore 11 and a second longitudinal recess or bore 12. The longitudinal bores 11 and 12 are disposed parallel to one another. The first longitudinal bore 11 has a diameter $d_1$, which is markedly greater than the diameter $d_2$ of the second longitudinal bore 12. The spacing between the parallel center lines of the two longitudinal bores 11 and 12 is equal to or greater than the radius, but less than the diameter $d_1$, of the first longitudinal bore 11.

A connection bore 13 is disposed generally radially in the base body 1 and discharges into the second longitudinal bore 12. The transition 14 between the first longitudinal bore 11 and the second longitudinal bore 12 is rounded.

The first longitudinal bore 11 in the tubular base body 1, in operation of the common rail of the invention, performs the function of storing fuel. The second longitudinal bore 12 in the tubular base body 1, in operation of the common rail of the invention, performs the function of distributing the fuel. By the separation of the functions of fuel storage and fuel distribution, the strength of the common rail of the invention can be increased.

The embodiments of the invention shown in FIGS. 3–8 differ primarily in layout and in the disposition of the individual elements. To avoid repetition, in the ensuing description of the these exemplary embodiments, only the differences between the various embodiments will be addressed. For the sake of simplicity, the same reference numerals are used to identify the same parts.

Figure 3:
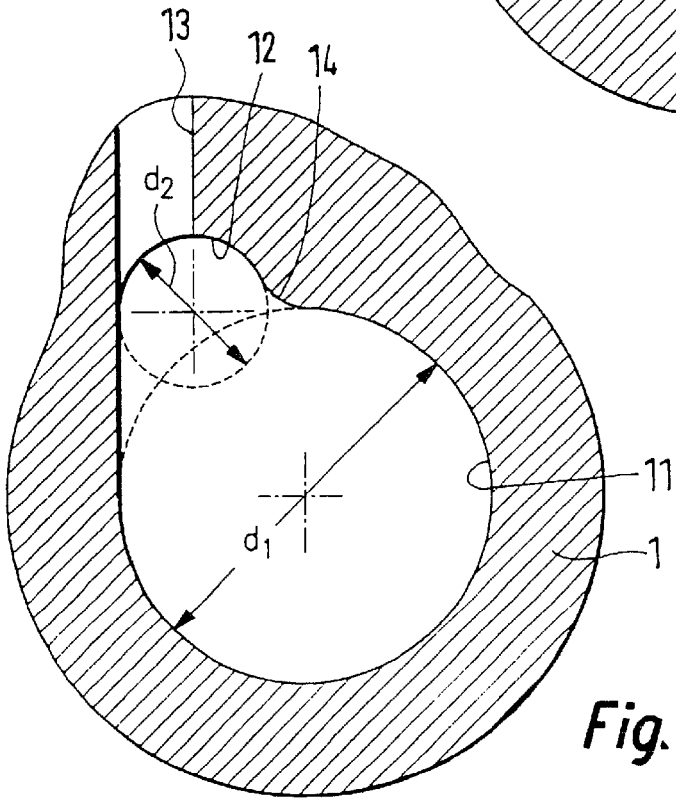

The common rail shown in cross section in FIG. 3, like the embodiment described above, has a tubular base body 1 with two parallel longitudinal bores 11 and 12. The second longitudinal bore 12 has a smaller diameter $d_2$ than the first longitudinal bore 11 ($d_1$). The transition 14 between the two longitudinal bores 11 and 12 is rounded.

In the embodiment shown in FIG. 3, the connection bore 13 discharges tangentially into the first and second longitudinal bores 11 and 12. The spacing between the center lines of the longitudinal bores 11 and 12 is at least equivalent to the radius of the first longitudinal bore 11.

Figure 4:
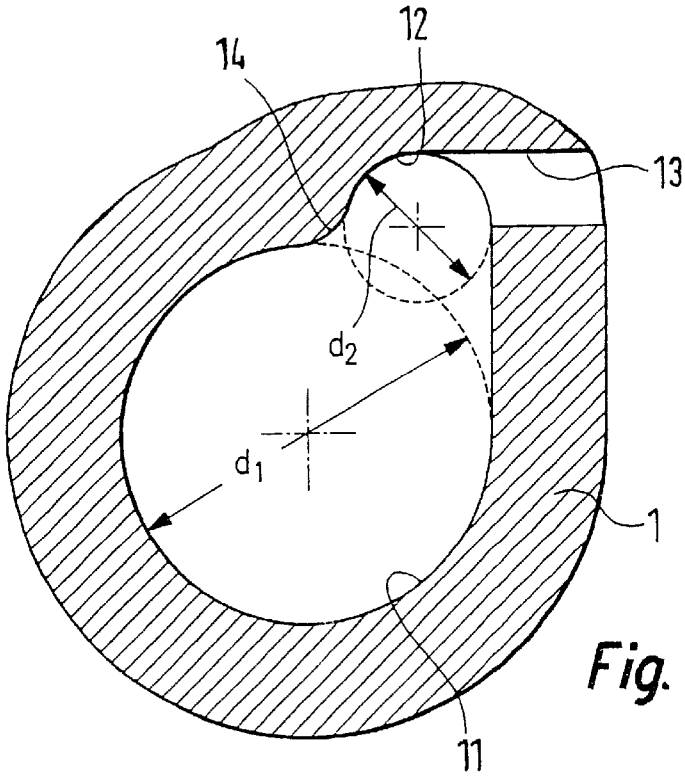

In the embodiment shown in FIG. 4, the spacing of the center lines of the two longitudinal bores 11 and 12 is somewhat greater than the radius of the first longitudinal bore 11. In addition, the connection bore 13 extends in a different direction from the connection bore 13 of the embodiment shown in FIG. 3. In the embodiments shown in FIGS. 3 and 4, the connection bores 13 are offset by 90° from one another.

Figure 5:
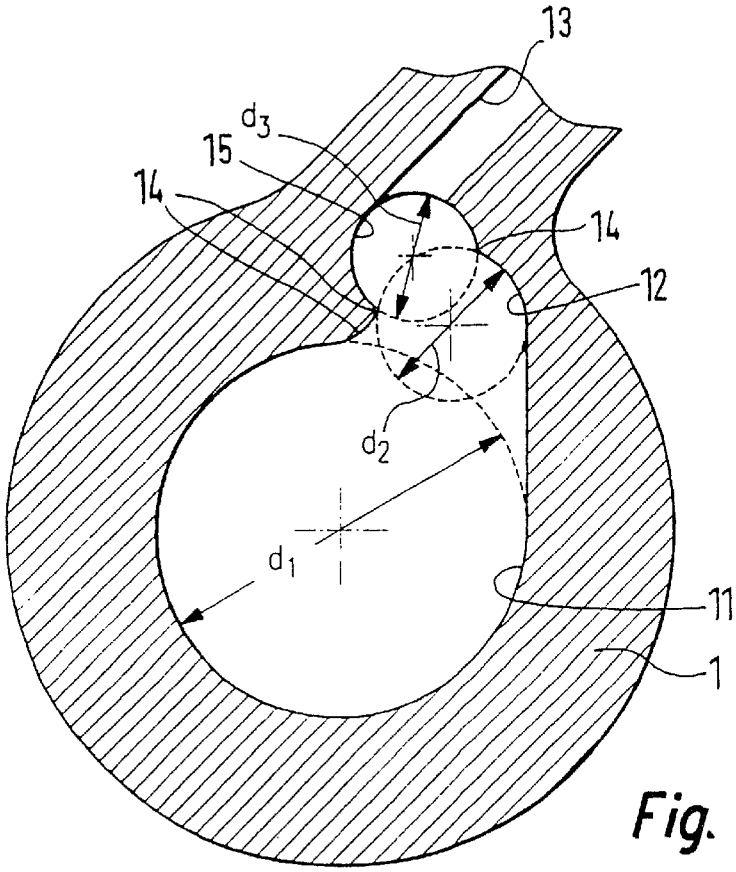

In the embodiment shown in FIG. 5, in addition to the first and second longitudinal bores 11 and 12, there is also a third longitudinal bore 15 parallel to the tubular base body 1. The third longitudinal bore 15 has a diameter $d_3$. The diameter $d_3$ is less than the diameter $d_2$, which in turn is less than the diameter $d_1$. The connection bore 13 discharges into the longitudinal bore 15 having the diameter $d_3$.

Figure 6:
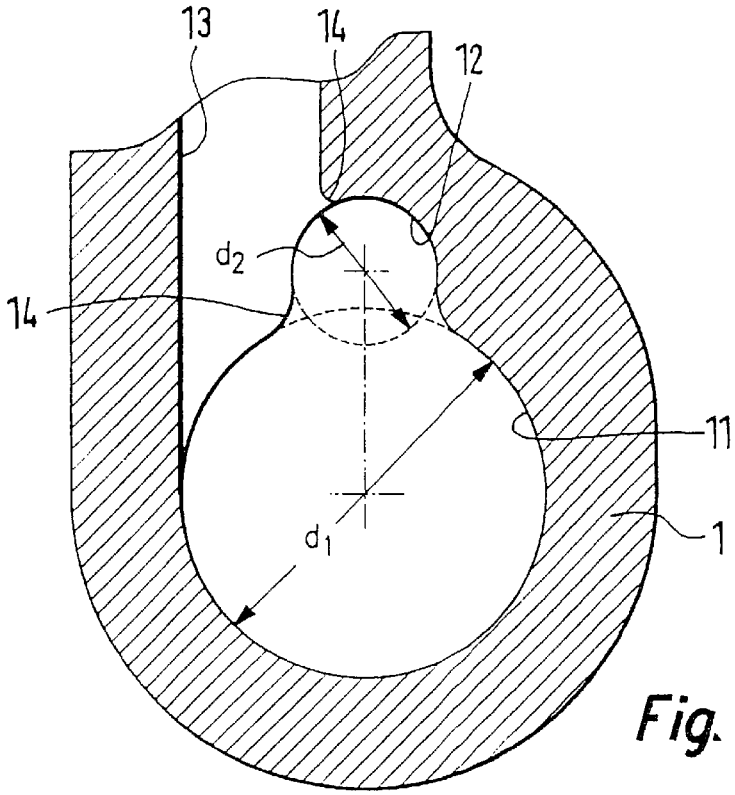

The embodiment shown in FIG. 6 is similar to the embodiment shown in FIG. 2. However, the connection bore 13 does not discharge tangentially into the second connection bore 12, as in the embodiment shown in FIG. 2, but instead, as seen in FIG. 6, tangentially into the first connection bore 11. The bores are disposed such that the connection bore 13 emerges eccentrically and smoothly from the first longitudinal bore 11.

Figure 7:
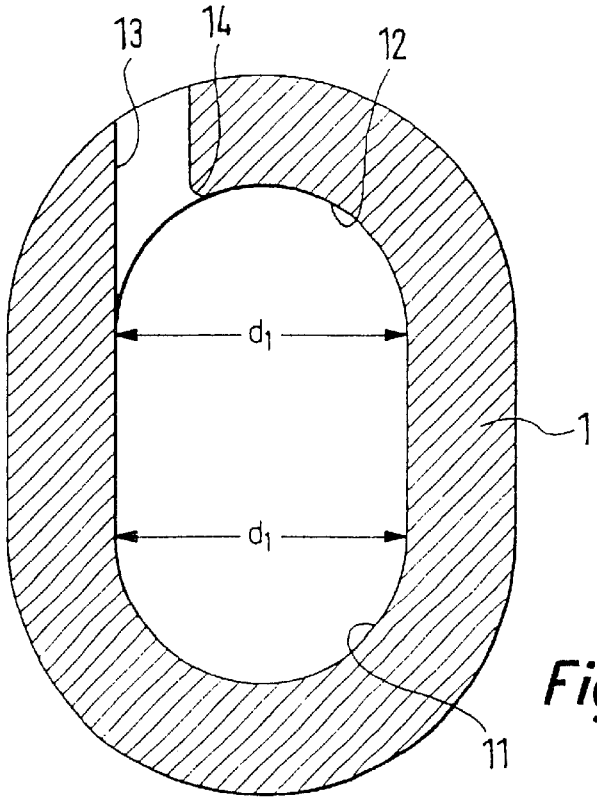

In the embodiment of the invention shown in FIG. 7, two longitudinal bores 11 and 12 with the same diameter $d_1$ are made in the tubular base body 1. The connection bore 13 discharges tangentially into the longitudinal bore 12. The transition region between the two longitudinal bores 11 and 12 is embodied smoothly.

Under high pressure, the interior of the base body 1 formed, which interior is formed by the two longitudinal bores, undergoes the greatest deformation perpendicular to the connection bore 13. As a result, the region of the eccentric connection bore 13 is not excessively stressed.

Figure 8:
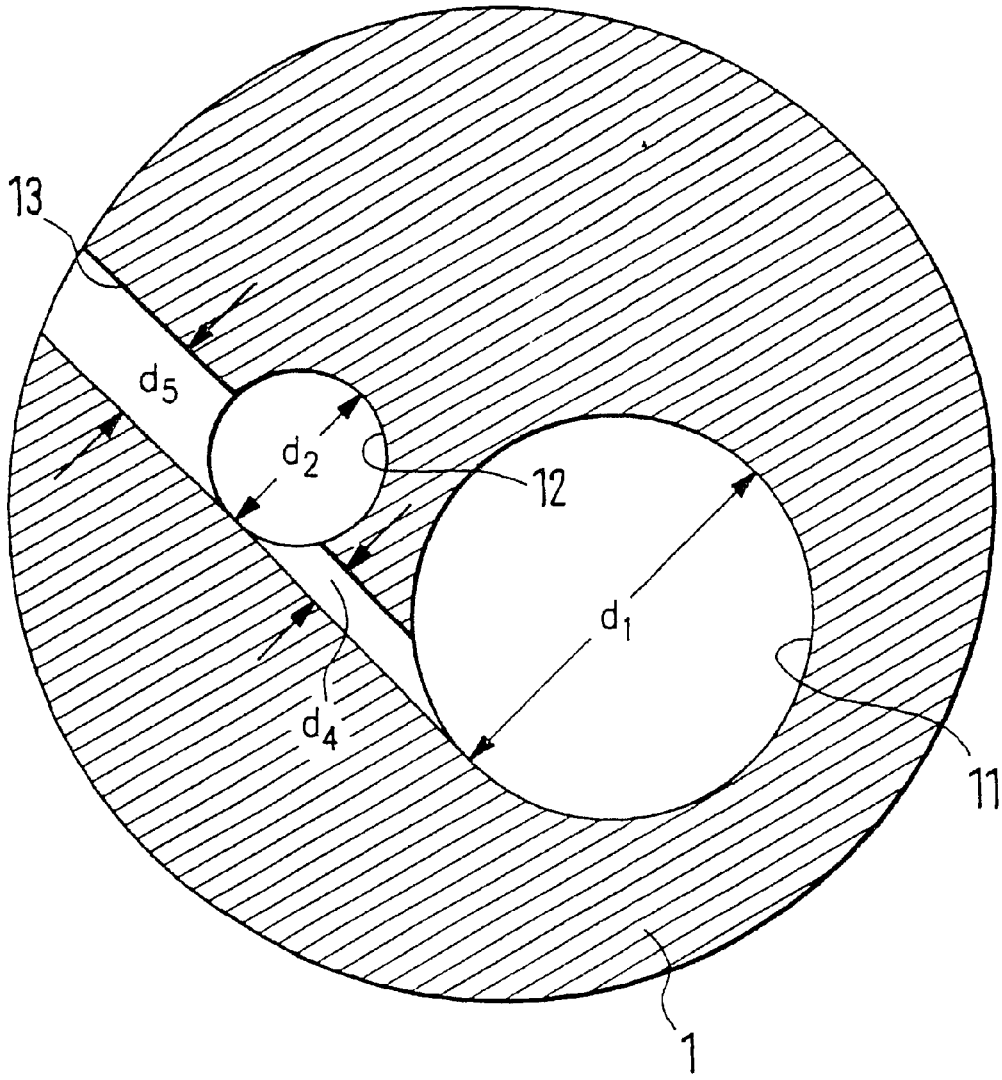

In the embodiment shown in FIG. 8, the first longitudinal bore 11 and the second longitudinal bore 12 are embodied separately in the tubular base body 1. The longitudinal bores 11 and 12 communicate with one another through a connecting bore having the diameter $d_4$. The connecting bore discharges tangentially into both longitudinal bores 11 and 12. The connection bore 13 has a diameter $d_5$, which is greater than the diameter $d_4$ of the connecting bore between bores 11 and 12. The connection bore 13 discharges tangentially into the second longitudinal bore 12. The connection bore 13 extends in the same direction as the connecting bore between the two longitudinal bores 11 and 12.

The foregoing relates to a preferred exemplary embodiment of the invention, it being understood that other variants and embodiments thereof are possible within the spirit and scope of the invention, the latter being defined by the appended claims.

What is claimed is:

1. A common rail for a common rail fuel injection system of an internal combustion engine, comprising a tubular base body (1) having an interior (11, 12, 15) communicating with a plurality of connections (2–5, 13), said interior being formed by at least two substantially circular-cylindrical recesses (11, 12, 15), said recesses communicating with one another and having longitudinal axes parallel to one another, said connections (13) originating only at the jacket face of one of the substantially circular-cylindrical recesses (11, 12, 15).

2. The common rail of claim 1, wherein said substantially circular-cylindrical recesses (11, 12) communicate with one another through a connecting conduit.

3. The common rail of claim 1, wherein said substantially circular-cylindrical recesses (11, 12) overlap in cross section.

4. The common rail of claim 1, wherein said substantially circular-cylindrical recesses (11, 12) have the same diameters, and wherein said connections (13) are disposed only in the longitudinal direction of the cross section of the base body interior.

5. The common rail of claim 1, wherein said substantially circular-cylindrical recesses (11, 12) have different diameters ($d_1$, $d_2$), and wherein said connections (13) originate only at the jacket face of the substantially circular-cylindrical recess (12) having the smaller diameter ($d_2$).

6. The common rail of claim 5, wherein the spacing between the longitudinal axes of the two substantially circular-cylindrical recesses (11, 12) is greater than or equal to the radius of the substantially circular-cylindrical recess (11) having the larger diameter ($d_1$).

7. The common rail of claim 5, wherein the transitions (14) between said substantially circular-cylindrical recesses (11, 12, 15) are rounded in cross section.

8. The common rail of claim 2, wherein said substantially circular-cylindrical recesses (11, 12, 15) have the same diameters, and wherein said connections (13) are disposed only in the longitudinal direction of the cross section of the base body interior.

9. The common rail of claim 3, wherein said substantially circular-cylindrical recesses (11, 12, 15) have the same diameters, and wherein said connections (13) are disposed only in the longitudinal direction of the cross section of the base body interior.

10. The common rail of claim 2, wherein said substantially circular-cylindrical recesses (11, 12, 15) have different diameters ($d_1$, $d_2$), and wherein said connections (13) originate only at the jacket face of the substantially circular-cylindrical recess (12) having the smaller diameter ($d_2$).

11. The common rail of claim 3, wherein said substantially circular-cylindrical recesses (11, 12, 15) have different diameters ($d_1$, $d_2$), and wherein said connections (13) originate only at the jacket face of the substantially circular-cylindrical recess (12) having the smaller diameter ($d_2$).

12. The common rail of claim 10, wherein the spacing between the longitudinal axes of said substantially circular-cylindrical recesses (11, 12, 15) is greater than or equal to the radius of the substantially circular-cylindrical recess (11) having the larger diameter ($d_1$).

13. The common rail of claim 11, wherein the spacing between the longitudinal axes of said substantially circular-cylindrical recesses (11, 12, 15) is greater than or equal to the radius of the substantially circular-cylindrical recess (11) having the larger diameter ($d_1$).

14. The common rail of claim 10, wherein the transitions (14) between said substantially circular-cylindrical recesses (11, 12, 15) are rounded in cross section.

15. The common rail of claim 11, wherein the transitions (14) between said substantially circular-cylindrical recesses (11, 12, 15) are rounded in cross section.

16. The common rail of claim 12, wherein the transitions (14) between said substantially circular-cylindrical recesses (11, 12, 15) are rounded in cross section.

17. The common rail of claim 13, wherein the transitions (14) between said substantially circular-cylindrical recesses (11, 12, 15) are rounded in cross section.

* * * * *